US007254362B2

(12) United States Patent
Kikuchi et al.

(10) Patent No.: US 7,254,362 B2
(45) Date of Patent: Aug. 7, 2007

(54) FIXING DEVICE, IMAGE FORMING APPARATUS USING THE FIXING DEVICE, AND HEAT INSULATING MEMBER

(75) Inventors: Hisashi Kikuchi, Kawasaki (JP); Takashi Fujita, Yokohama (JP); Yukimichi Someya, Saitama (JP); Katsuhiro Echigo, Asaka (JP); Hiroyuki Kunii, Yokohama (JP); Shigeo Kurotaka, Sagamihara (JP); Atsushi Nakafuji, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 105 days.

(21) Appl. No.: 10/982,783

(22) Filed: Nov. 8, 2004

(65) Prior Publication Data

US 2005/0152721 A1 Jul. 14, 2005

(30) Foreign Application Priority Data

Nov. 7, 2003 (JP) ..... 2003-378196
Sep. 16, 2004 (JP) ..... 2004-269840

(51) Int. Cl.
*G03G 15/20* (2006.01)

(52) U.S. Cl. ..... 399/333; 399/328

(58) Field of Classification Search ..... 399/326, 399/327, 328, 329, 330, 331, 333; 219/216; 347/156; 252/62; 106/122, 672
See application file for complete search history.

(56) References Cited

U.S. PATENT DOCUMENTS 3,868,744 A * 3/1975 Thettu ..... 399/327 X
6,122,479 A 9/2000 Fujita et al.
6,501,935 B2 12/2002 Hirai et al.
6,542,705 B2 4/2003 Fujita et al.
6,559,421 B1 5/2003 Yura et al.
6,577,817 B2 * 6/2003 Harris ..... 392/481
6,795,678 B2 9/2004 Yura et al.
6,871,041 B2 * 3/2005 Takagi et al. ..... 399/330
7,006,781 B2 * 2/2006 Imai et al. ..... 399/333

FOREIGN PATENT DOCUMENTS

| | | |
|---|---|---|
| JP | 05-069515 | 3/1993 |
| JP | 3069476 | 3/2000 |
| JP | 2000-206815 | 7/2000 |
| JP | 2000-275996 | 10/2000 |
| JP | 2001-065544 | 3/2001 |
| JP | 2001-343850 | 12/2001 |
| JP | 2002-040855 | 2/2002 |

OTHER PUBLICATIONS

U.S. Appl. No. 11/521,494, filed Sep. 15, 2006, Takagaki et al.
U.S. Appl. No. 11/669,817, filed Jan. 31, 2007, Suzuki et al.

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A fixing device containing at least one fixing member configured to fix a toner image on a transfer material, which includes a first substrate and a pressing member configured to form a nip with the at least one fixing member, which includes a second substrate, and a heater. At least one of the at least one fixing member and the pressing member further contains a heat insulating layer overlying the first or second substrate.

33 Claims, 11 Drawing Sheets

FIXING DEVICE, IMAGE FORMING APPARATUS USING THE FIXING DEVICE, AND HEAT INSULATING MEMBER

BACKGROUND OF THE INVENTION

1. Field of the Invention

The present invention relates to a fixing device for use in fixing unfixed toner particles onto a recording medium, and an image forming apparatus using the fixing device.

2. Discussion of the Background

Image forming apparatuses using electrophotography include a fixing device to fix an unfixed toner image transferred onto a recording medium. Such a fixing device typically adopts a heat roller system.

A fixing device adopting a heat roller system includes a fixing roller containing a heat source such as a halogen heater therein and a pressure roller. The pressure roller is in contact under pressure with the fixing roller, thereby forming a nip therebetween. The fixing device adopting a heat roller system fixes unfixed toner images onto a recording medium while the recording medium is passing through the nip. The fixing roller used in the fixing device adopting a heat roller system is formed of a core made of, for example, metals, on which an elastic layer (i.e., a heat insulating layer) and a release layer are formed. This type of fixing device has a relatively large thermal capacity. It naturally takes a long time to raise the temperature of such a roller by heat from room temperature to a predetermined temperature.

Reduction in the time needed to be taken to raise the temperature (hereinafter referred to as rise time) is essential for energy saving. By reducing the thickness of the core and the elastic layer of such a roller applying heat to unfixed toner, a relatively low thermal capacity can be imparted to the roller, resulting in shortening the rise time of the roller. The roller applying heat to unfixed toner refers to a roller directly heated by a heater. However, a background roller applying heat to unfixed toner typically contains a heat source therein. Therefore it takes a long time before the heat is conveyed to the surface of the roller. Especially, when the roller is used for fixing color images, the elastic layer thereof has to be sufficiently thick to obtain quality images. Therefore, such a roller has a long rise time. In addition, it also takes a long time to raise the temperature of such a roller to a predetermined temperature again after the roller is deprived of heat by a recording medium passing through the nip. Therefore, when recording media consecutively pass through the nip, the fixing ability of a fixing device using such a roller deteriorates because the temperature of the heat roller falls.

Published unexamined Japanese Patent Application No. JP 2002-40855 discloses a fixing device including a system in which a heat source is disposed outside the fixing member to directly apply heat to the surface thereof. In this system, the fixing roller has a substantially short rise time because heat is applied only to the surface layer to be heated and in addition has a quick response to the temperature fall caused by recording media passing through the nip. However, the heat conveyed to the surface layer in fact diffuses into a portion not to be heated such as the inside of the fixing roller and the pressure roller. Thus, the actual rise time of the fixing roller is longer than its theoretical time.

It is possible to shorten the rise time of a fixing roller by forming a heat insulating layer under the surface layer of the heating roller to improve thermal insulation properties thereof. As materials having good thermal insulation properties, there are materials containing a gas such as air having a low specific thermal conductivity therein. As disclosed in JP 2000-206815, foamed silicone rubber is widely used. Foamed silicone has a low specific thermal conductivity and good thermal insulation properties because of air contained therein. However, the air contained in the foamed silicone is compressed at the nip, resulting in reduction in the content ratio of the air. Thereby, the specific thermal conductivity of the foamed silicone becomes high. In addition, foamed silicone is easily transformed by compression. Thus, it is unsuitable to apply a high plane pressure to foamed silicone. Further, foamed silicone tends to deteriorate over time with repetitive transformation. Furthermore, foamed silicone has another drawback in that, since the rotation radius of a foamed silicone roller varies under compression, such a roller is not suitable as a driving roller to convey recording media, etc., at a constant speed.

JP 2002-40855 exemplifies porous ceramics and porous resin as a thermal insulation material having a high rigidity with little transformation. JP 2000-275996 and JP 2001-65544 disclose a binder mixed with hollow particles. However, these materials have insufficient thermal insulation properties.

Further, JP 2001-343850 discloses a fixing roller including a heat insulating layer formed of accumulated layers including resin films having holes. However, this structure has a drawback in that it is difficult to appropriately position the holes in adjacent film layers and to form a heat insulating layer having a large void ratio.

SUMMARY OF THE INVENTION

In view of these reasons, the present investors recognized a need exists for a fixing device that can avoid heat diffusion into a portion not to be heated, to thereby shorten waiting time and save energy.

Accordingly, an object of the present invention is to provide a fixing device comprising a member for fixing and other members such as a cleaning member to remove toner adhered to the member for fixing that have good thermal insulation properties to avoid heat diffusion to a portion not to be heated for shortening waiting time and saving energy. The member for fixing represents a fixing member, a pressure member, etc., which form a nip.

Another object of the present invention is to provide an image forming apparatus comprising the fixing device.

Briefly, these objects and other objects of the present invention as hereinafter will become more readily apparent can be attained by a fixing device comprising at least one fixing member configured to fix a toner image on a transfer material, comprising a first substrate, a pressing member configured to form a nip with the at least one fixing member, comprising a second substrate, and a heater. At least one of the at least one fixing member and the pressing member further comprises a heat insulating layer overlying the first or second substrate.

It may be preferred that the heat insulating layer comprises accumulated film layers and a filler dispersed between the accumulated film layers to form a space therebetween.

It may be preferred that the filler is a particulate material.

It may be preferred that the filler is a particulate hollow material.

It may be preferred that the filler has a fiber.

It may be preferred that the filler has a hollow fiber.

It may be preferred that the accumulated film layers are adhered to each other or the film layers and the filler are adhered to each other.

It may be preferred that, in the fixing device mentioned above, at least one of the at least one fixing member and the pressing member comprises a roller substrate and the accumulated film layers comprises a film sheet that is spirally wound around the roller substrate in such a way that the winding direction of the film sheet is opposed to the rotation direction of the roller substrate.

It may be preferred that the heat insulating layer further comprises accumulated film layers and each of the accumulated film layers has a concavo-convex surface to form a space therebetween.

It may be preferred that the heat insulating layer further comprises a filler dispersed between the accumulated film layers having a concavo-convex surface.

It may be preferred that the heat insulating layer further comprises a flat film alternately disposed with the film layer having concavo-convex surface.

It may be preferred that the at least one fixing member is a heat induction roller comprising a heat generating layer located overlying the heat insulating layer.

It may be preferred that the fixing device mentioned above further comprises a fixing belt that is rotated while being sandwiched by the at least one fixing member and the pressing member.

It may be preferred that the fixing device mentioned above further comprises a heat roller heated by the heater and a fixing belt that receives heat of the heat roller. The fixing belt is rotated while supported by the at least one fixing member and the heat roller and is sandwiched by the at least one fixing member and the pressing member to apply heat to unfixed toner image.

It may be preferred that, in the fixing device mentioned above, the heater is located inside the at least one fixing member.

It may be preferred that, in the fixing device mentioned above, the heater is disposed in the vicinity of the at least one fixing member to apply heat thereto.

It may be preferred that the heater disposed in the vicinity of the at least one fixing member to apply heat thereto directly applies heat to the toner image on the transfer sheet.

It may be preferred that the heat insulating layer comprises accumulated thermoplastic resin film layers and a particulate hollow material dispersed therebetween while fixed thereto by a thermoplastic resin.

It may be preferred that the fixing device mentioned above further comprises at least one cleaning member comprising a substrate and a second heat insulating layer. The at least one cleaning member cleans the surface of at least one of the at least one fixing member and the pressing member.

It may be preferred that the second heat insulating layer comprises accumulated film layers each of which has a concavo-convex surface to form a space therebetween.

As another aspect of the present invention, a fixing device is provided that comprises a fixing member configured to fix a toner image, a pressing member configured to form a nip with the fixing member, a heater, and a cleaning member configured to clean the surface of at least one of the fixing member and the pressing member. The cleaning member comprises a substrate and a heat insulating layer.

As another aspect of the present invention, an image forming apparatus is provided that comprises a photoreceptor, an irradiator configured to irradiate the photoreceptor to form a latent image on the photoreceptor, a developing device configured to develop the latent image on the photoreceptor with a toner to form a toner image on the photoreceptor, a cleaner configured to remove toner remaining on the photoreceptor, a discharging device configured to discharge the photoreceptor, a transferring device configured to transfer the toner image to a recording medium, and the fixing device mentioned above.

As another aspect of the present invention, a heat insulating member is provided that comprises a support and a heat insulating layer located overlying the support. The heat insulating layer comprises accumulated film layers and a filler dispersed between the accumulated film layers to form a space therebetween. As another aspect of the present invention, a heat insulating member is provided that comprises a support and a heat insulating layer located overlying the support. The heat insulating layer comprises accumulated film layers and each layer has a concavo-convex surface to form a space therebetween.

These and other objects, features, and advantages of the present invention will become apparent upon consideration of the following description of the preferred embodiments of the present invention taken in conjunction with the accompanying drawings.

BRIEF DESCRIPTION OF THE DRAWINGS

Various other objects, features, and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention is now described below in detail with reference to several embodiments and accompanying drawings.

Members for fixing represent a fixing member and a pressure member. Rollers for fixing represent a fixing roller and a pressure roller.

Figure 1:
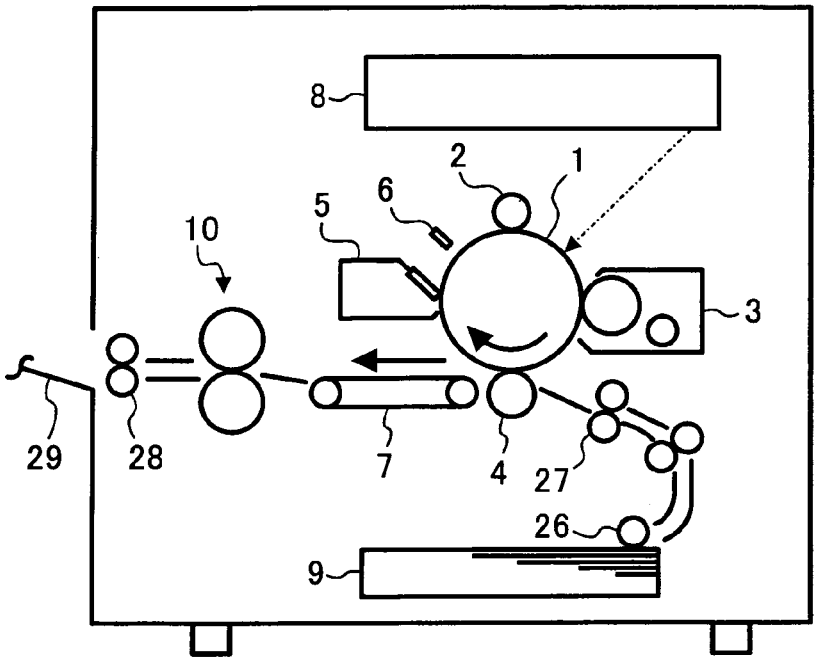
FIG. 1 is a cross section illustrating an embodiment of the image forming apparatus to which the fixing device of the present invention is attachable.

FIG. 1 is a cross section illustrating an embodiment of an image forming apparatus to which a fixing device of the present invention is attachable. Schematic structure and operations of this image forming apparatus are briefly described below.

The image forming apparatus illustrated in FIG. 1 is a printer. In the approximate center of the body of the printer, an image developing portion including a photoreceptor drum 1, etc., is situated. Around the photoreceptor drum 1, a charging device 2, a developing device 3, a transfer device 4, a cleaning device 5, and a discharging device 6, etc., are disposed. A known optical writing device 8 is disposed above the developing portion. A paper feeder cassette 9 is located below the developing portion. To the left of the developing portion, a fixing device 10 is disposed. The transfer device 4 and the fixing device 10 are connected with a conveyer belt 7. Other fixing devices described later in each embodiment can be used instead of the fixing device 10.

In this structured printer, writing signals are transmitted from a host machine (not shown), for example a computer. An irradiating device 8 is driven according to received image signals and light is emitted from a laser beam source of the irradiating device 8. The light is scanned by a polygon mirror rotationally driven by a motor and irradiated by mirrors, etc. to the photoreceptor drum 1 uniformly charged by the charging device 2. Then, a latent image corresponding to the writing information is formed on the photoreceptor drum 1. The latent image formed on the photoreceptor drum 1 is developed with toner by the developing device 3 and the developed toner image is borne on the surface of the photoreceptor drum 1.

The paper set at the top of the bunch of paper set in the paper feeder cassette 9 is fed by the paper feeder roller 26 and is sent out by a register roller 27 at an appropriate timing of the toner image borne on the photoreceptor drum 1.

The toner image on the photoreceptor drum 1 is transferred onto a paper by the transfer device 4. The toner remaining on the surface of the photoreceptor drum 1 after this transfer is removed by the cleaning device 5. Then the photoreceptor drum 1 is discharged by the discharging device 6 for the next cycle.

The paper onto which the toner image is transferred is sent to the fixing device 10 by the conveyer belt 7. The toner image is fixed on the paper by application of heat and pressure. The paper on which the toner image is fixed is output to a tray 29 by a paper discharging roller 28.

Next, an embodiment of the fixing device is described.

Figure 2:
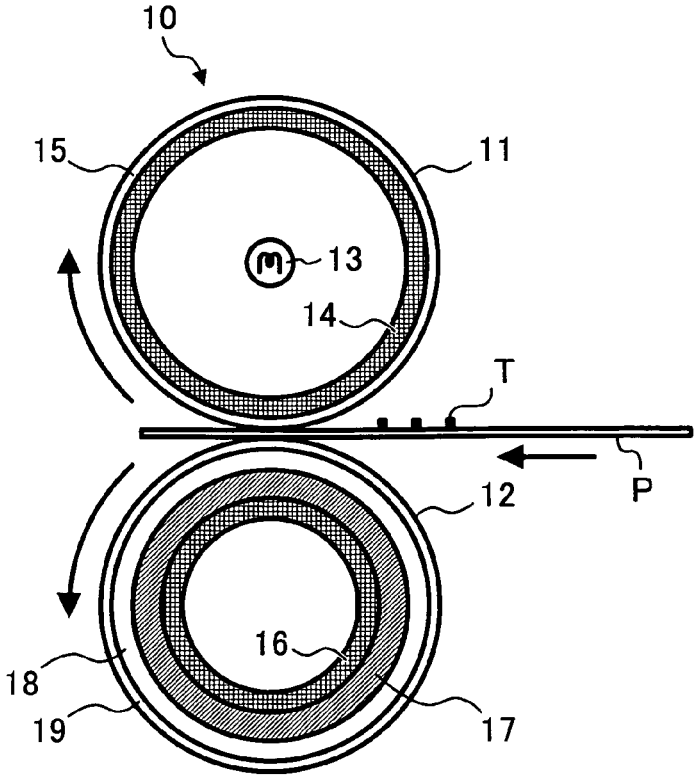
FIG. 2 is a cross section illustrating a first embodiment of a fixing device of the present invention.

The fixing device 10 illustrated in FIG. 2 includes a fixing roller 11, a pressure roller 12, and a halogen heater 13 functioning as a heating device. These devices are housed in a fixing casing (not shown). The fixing roller 11 and the pressure roller 12 form a nip while in contact under pressure with each other. A toner image T on a recording medium P, for example a transfer paper, is fixed on the recording medium P upon application of heat and pressure while the recording medium P is passing between the rollers for fixing (i.e., the fixing roller 11 and the pressure roller 12) rotating in the directions indicated by respective arrows.

A temperature detection device (not shown) is attached to the fixing roller 11. Electric current to the halogen heater is controlled according to the output of the temperature detection device such that the temperature of the fixing roller 11 is maintained at a predetermined temperature. The fixing roller 11 in this embodiment includes a metal core 14 having a diameter of 30 mm and a TEFLON® layer 15 functioning as a release layer having a thickness of 10 μm coated thereon, as examples. The pressure roller 12 is a thermal insulation roller having an outer diameter of 30 mm that includes a metal core 16 and a heat insulating layer 17 having a thickness of 1 mm thereon, as examples. On the heat insulating layer 17, an elastic layer 18 (i.e., a silicone rubber layer) having a thickness of, e.g., 0.3 mm is formed. As a release layer 19 (i.e., a surface layer), PFA tube having a thickness of 15 μm is coated on the elastic layer 18, as an example. The elastic layer 18 is provided to the pressure roller 12 when the fixing roller 11 forming a nip under pressure with the pressure roller 12 is hard. However, the pressure roller 12 can dispense with the elastic layer 18 when the fixing roller 11 has an elastic layer or this thermal insulation roller (i.e., the pressure roller 12) is used as a supporting roller for a fixing belt.

FIGS. 3 to 6 are cross sections of the pressure roller 12 illustrating embodiments of the structure of the heat insulating layer 17. The structures illustrated in FIGS. 3 to 6 include the metal core 16 on which the heat insulating layer 17 and the release layer 19 are formed without the elastic layer 18.

Figure 3:
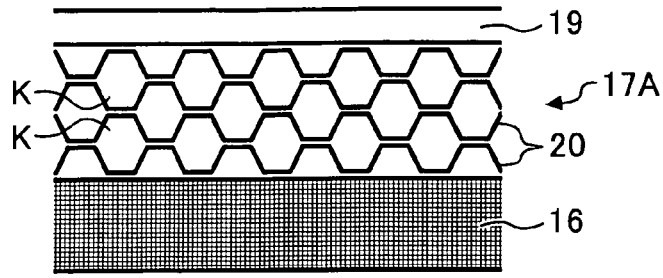
FIG. 3 is a partial cross section illustrating an embodiment of a structure of a heat insulating layer of a roller for fixing.

In FIG. 3, the heat insulating layer 17A formed between the metal core 16 and the release layer 19 includes accumulated layers formed by concavo-convex films 20. In this embodiment, as illustrated in FIG. 3, the adjacent layers of the concavo-convex films 20 are formed in a manner that the concavity and the convexity thereof are alternately arranged to form spaces K in the heat insulating layer 17A.

Figure 7:
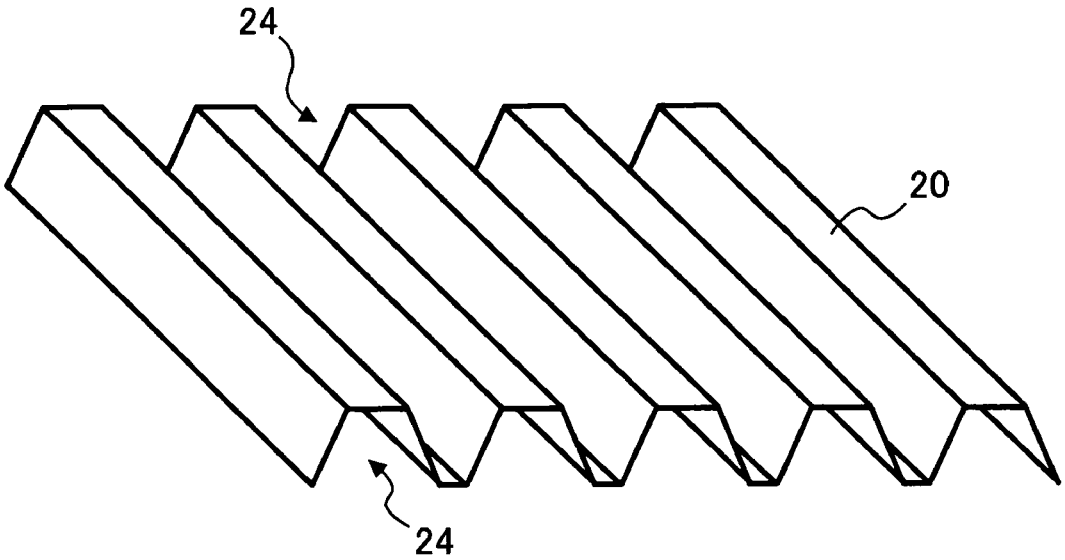
FIG. 7 is a perspective diagram illustrating an embodiment of a concavo-convexity film.
Figure 8:
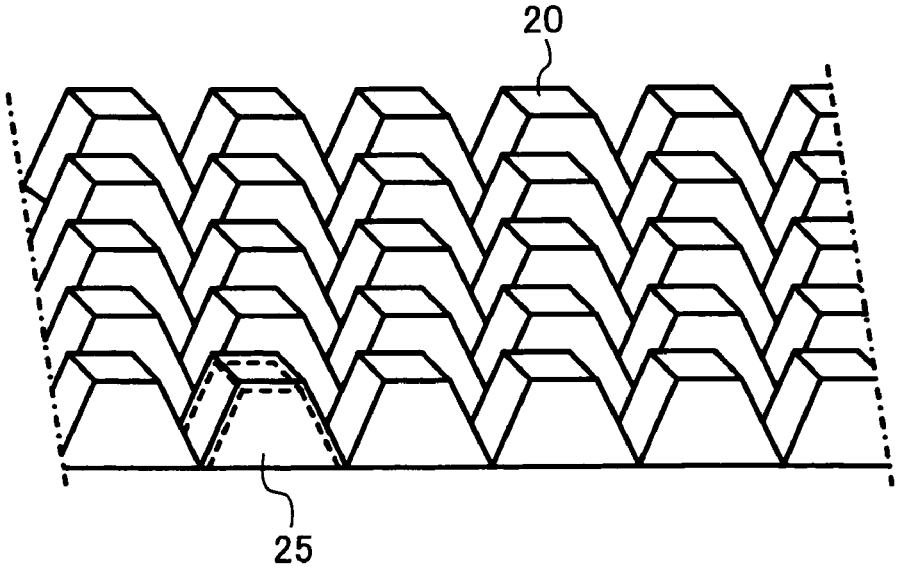
FIG. 8 is a perspective diagram illustrating another embodiment of a concavo-convexity film.
Figure 9:
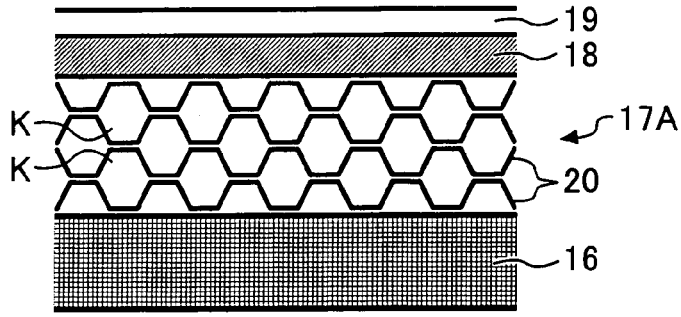
FIG. 9 is a partial cross section illustrating an embodiment of a structure of a heat insulating layer of a roller for fixing having an elastic layer.
Figure 10:
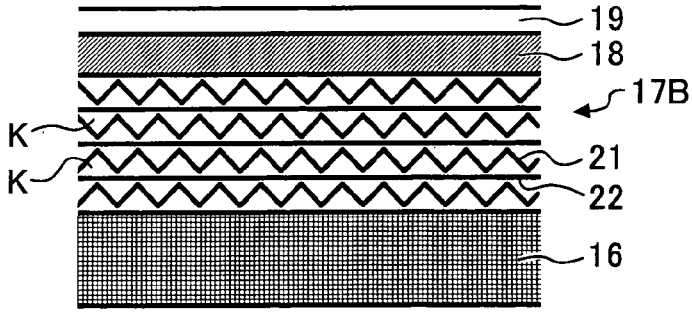
FIG. 10 is a partial cross section illustrating another embodiment of a structure of a heat insulating layer of a roller for fixing having an elastic layer.
Figure 11:
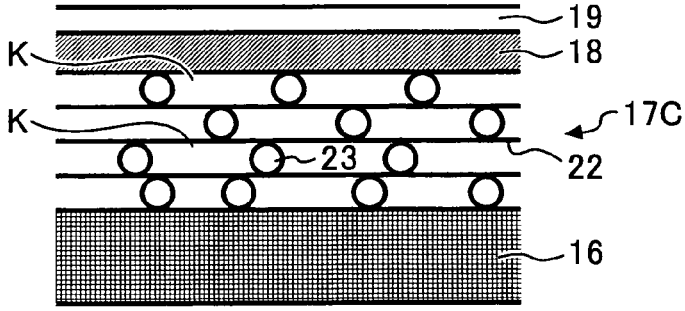
FIG. 11 is a partial cross section illustrating yet another embodiment of a structure of a heat insulating layer of a roller for fixing having an elastic layer.
Figure 12:
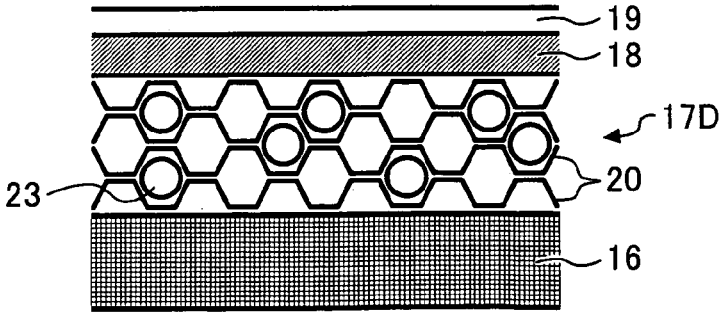
FIG. 12 is a partial cross section illustrating still another embodiment of a structure of a heat insulating layer of a roller for fixing having an elastic layer.

Each concavo-convex film 20 can be formed by embossing a flat film. For example, as in FIG. 7, a film layer of the film 20 having long ditches 24 extending in parallel can be alternately accumulated on each other. As illustrated in FIG. 8, convexities (or concavities) 25 having a trapezoid cross section can be formed on the film 20. In the case of the structure illustrated in FIG. 7, the film 20 can be disposed such that the long ditch 24 extends in the direction of the axis of a roller for fixing or the circumference thereof. The cross section of the long ditch 24 and the concavity 25 is not limited to a trapezoid form but can take any form such as a waveform having a triangle cross section, a polygonal form, a conical form, a polygonal pyramid form, etc. The triangle cross section is advantageous in strength.

Figure 4:
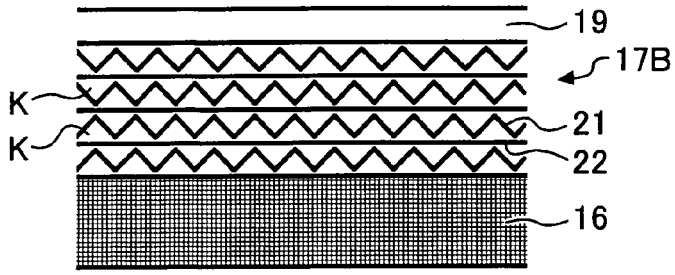
FIG. 4 is a partial cross section illustrating another embodiment of a structure of a heat insulating layer of a roller for fixing.

As illustrated in FIG. 4, a heat insulating layer 17B provided between the metal core 16 and the release layer 19 includes layers of film 21 having a serration form and layers of flat film 22. The layers of film 21 and the layers of film 22 are alternately formed to form spaces K. The film 21 having a serration form can be formed by embossing or accordion-folding a flat film. In this embodiment, the spaces K are securely formed because the flat film 22 is inserted between the layers of the film 21 having a serration form in the heat insulating layer 17B to prevent the concavity of the serration form film from fitting in the convexity of its adjacent serration form film.

Figure 5:
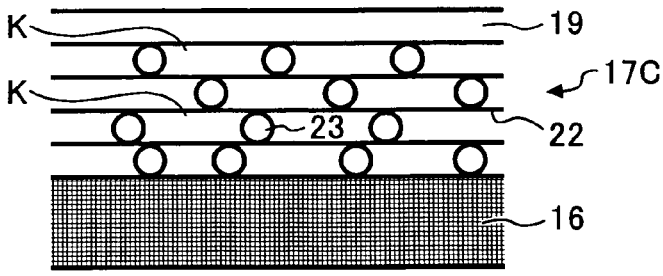
FIG. 5 is a partial cross section illustrating yet another embodiment of a structure of a heat insulating layer of a roller for fixing.

The embodiment illustrated in FIG. 5 has a structure in which particles 23 as a filler are dispersed between the layers of flat film 22 to form spaces K. In this embodiment, it is easy to set a void ratio in the heat insulating layer based on the particle diameter and the number of particles dispersed. The thermal insulation effect can be improved by using hollow or vacuum particles 23. In addition, it is preferred to fix the position of the particles 23 by, for example, adhering the particles 23 to the films 22 because the fixed particles 23 are prevented from moving and dispersing unevenly between the films due to, for example, the pressure during operation. The filler disposed between the films 22 is not limited to particles. For example, a fiber form filler can be used, and especially a hollow fiber or a fiber having a large void ratio is suitable from a thermal insulation point of view.

Figure 6:
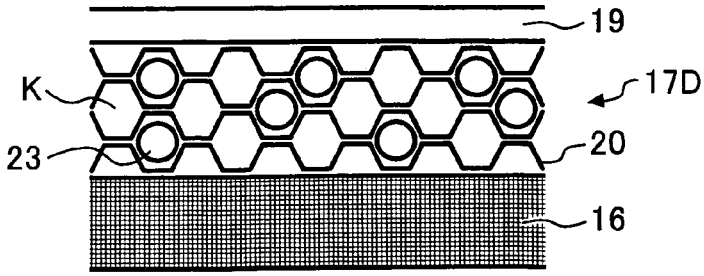
FIG. 6 is a partial cross section illustrating still another embodiment of a structure of a heat insulating layer of a roller for fixing.

The embodiment illustrated in FIG. 6 has a structure in which the particles 23 are disposed as filing members between the concavo-convex films 20. Namely, the particles 23 are dispersed in a suitable ratio in the spaces K between the layers of the films 20 of the embodiment illustrated in FIG. 3. As compared with the embodiment illustrated in FIG. 3, this structure has a lower void ratio on account of the particles 23 but is advantageous in strength. Further, it is possible to restrain a decrease in the void ratio by using hollow particles or vacuum particles.

FIGS. 9 to 12 are diagrams illustrating roller structures with an elastic layer. The roller includes a metal core 16 on which a heat insulating layer 17, an elastic layer 18, and a release layer 19 are formed. Heat insulating layers 17A to 17D illustrated in FIGS. 9 to 12 are structurally the same as the thermal insulation layers illustrated in FIGS. 3 to 6. When a color image is fixed by using a fixing device without an elastic layer, its image quality is low. Therefore, it is preferred to provide the elastic layer 18 formed of, for example, silicone rubber between the heat insulating layer 17 and the release layer 19 as illustrated in FIGS. 9 to 12 for a fixing device for use in fixing color images.

In addition, spaces K in the heat insulating layers 17A to 17D are preferably formed as open spaces.

When the spaces are closed in the heat insulating layer 17, the roller diameter may become large by the internal air inflated by heat, resulting in fluctuation in conveying speed. Therefore, the ends of the heat insulating layer in the direction of the roller axis are preferably not sealed to let the internal air in the heat insulating layer escape from the ends of the roller through the continuous space. It is thus possible to prevent the fluctuation in the roller diameter even when the internal air in the heat insulating layer is inflated by heat.

Figure 13:
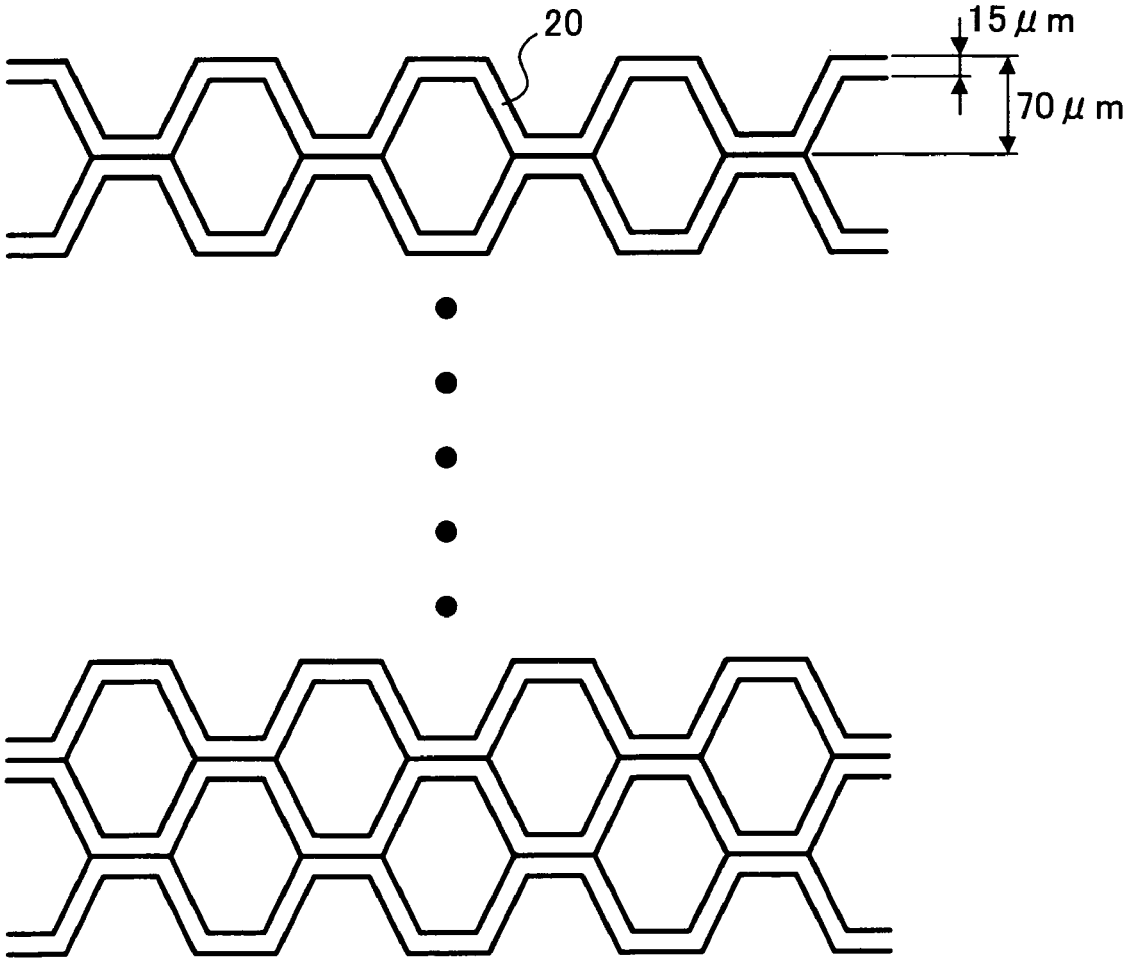
FIG. 13 is a partial cross section illustrating an embodiment of a heat insulating layer comprising a concavo-convexity film illustrated in FIGS. 3 and 7.

Any materials workable to thin film forms can be used to form the heat insulating layers 17A to 17D. Specific examples of such materials include polyesters, polyimides, polyamide-imides, polybenzo imidazoles, polybenzo bisoxazoles, polyphenylene sulfides. In the embodiments of the present invention, polyimides and polyphenylene sulfides are adopted considering thermal resistance, specific thermal conductivity, and strength of the material. Adiathermancy and strength of the heat insulating layer can be controlled by adjusting the thickness of the film and the dimensions of concavity and convexity (i.e., dimensions of the spaces K). In the embodiments of the present invention, when a polyphenylene sulfide film is used, the polyphenylene sulfide film may have a thickness of 15 μm, and a concavity and convexity height difference of 70 μm. When the heat insulating layer 17 has about 10 film layers, adiathermancy thereof is sufficient. When the thickness of the entire heat insulating layer 17 is 0.5 mm, and preferably about 1 mm, it is possible to shorten the rise time. FIG. 13 illustrates a heat insulating layer comprising the concavo-convexity film 20 of FIG. 7 as an example.

Specific examples of the hollow particles 23 for use in the structure examples illustrated in FIGS. 5, 6, 11, and 12 include resin balloons such as phenol particles and inorganic balloons such as glass balloons and silica balloons. As the thickness of the wall of the hollow particles decreases, the void ratio thereof increases. Therefore, a thin wall is preferred as long as the strength of the hollow particle allows.

Figure 14A:
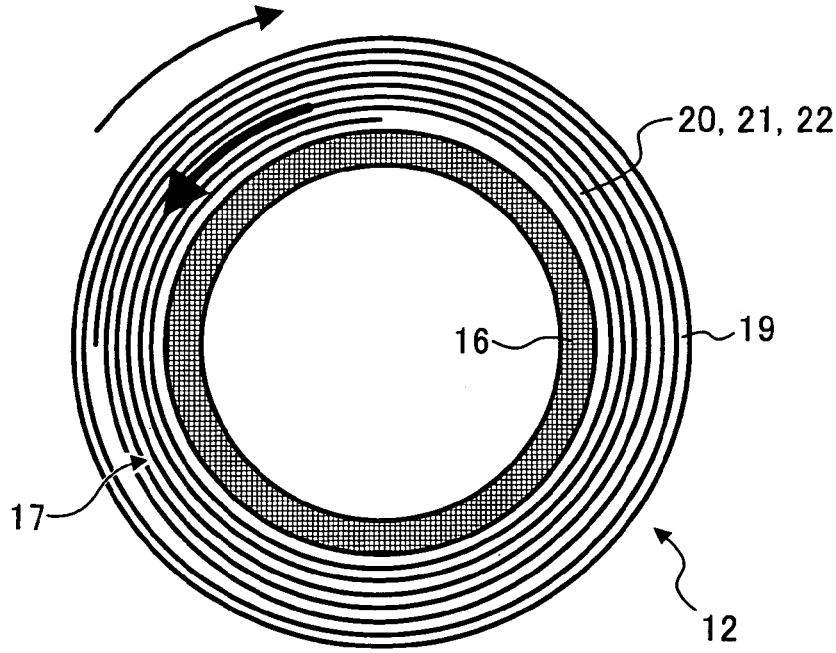
FIGS. 14A and 14B are cross sections illustrating an embodiment of a roller for fixing with a winding direction of a film of a heat insulating layer with an elastic layer and without an elastic layer, respectively.
Figure 14B:
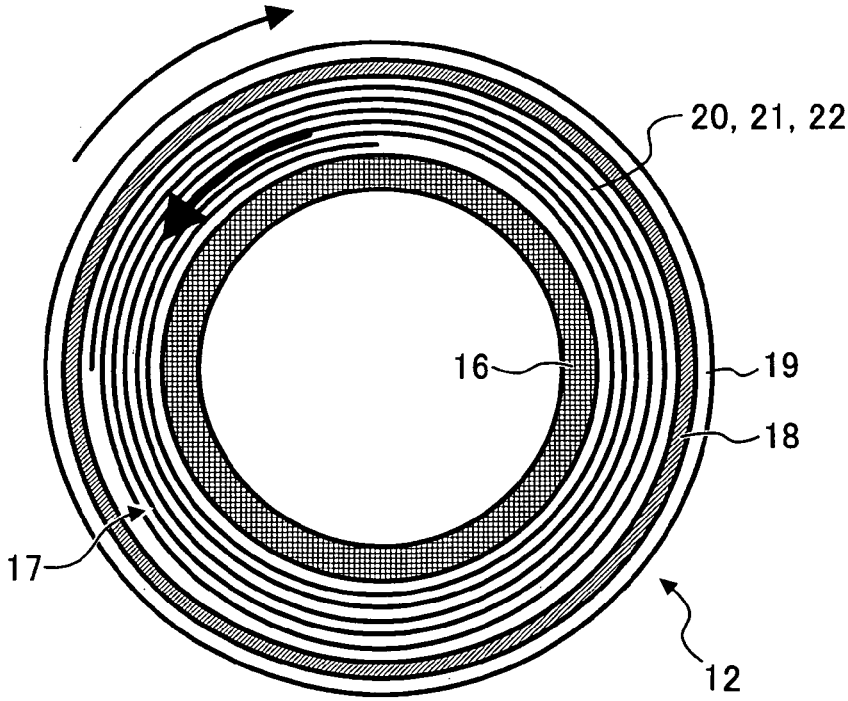

In addition, as illustrated in FIGS. 14A, 14B, when a film 20 (21, 22) is wound and formed on the metal core 16 to form the heat insulating layer 17, the rolled film 20 (21, 22) does not loosen when the film 20 (21, 22) is wound in the direction against the rotation direction indicated by an arrow (i.e. clockwise in this figure). Further, when the film 20 (21, 22) is suitably adhered to each other or to the particles 23, it is more securely possible to prevent slack of the film 20 (21, 22), and thus the reliability is enhanced. To adhere films or films with particles, materials having a high heat resistance such as silicone rubber or a film including an adhesive layer such as an UPILEX® film (manufactured by Ube Industries, LTD.), a KAPTON® film (manufactured by Du Pont-Toray Co., Ltd.) can be used. Also, thermal plastic resin films can be used for a heat insulating layer. When such a thermal plastic resin film is wound around a roller for fixing, the films and the films and particles can be subject to heat treatment at around the melting temperature of the resin to adhere and fix the films or the films and the particles by heat adhesion.

FIG. 14A is a roller structure example that does not have an elastic layer between the heat insulating layer 17 and the release layer 19 while FIG. 14B is a roller structure example that contains an elastic layer 18 therebetween. At the end of the roll of the film forming the heat insulating layer 17, there is a step corresponding to a film layer, but this step can be ignored by forming the elastic layer 18.

The structures of the heat insulating layers 17A to 17D illustrated in FIGS. 3 to 6 and 9 to 12 have a high void ratio and thus a good adiathermancy as compared with traditional heat insulating materials such as foamed silicone rubber.

Therefore, in the structure illustrated in FIG. 2, the heat of the fixing roller 11 is not easily transferred to the metal core 16 of the pressure roller 12. It is thereby possible to shorten the rise time of the fixing roller 11 and restrain a fall in the temperature thereof when paper is continuously fed. Further, the heat insulating layer has a good rigidity since a resin film is used. Having a good rigidity, the heat insulating layer does not transform at compression at the fixing nip. Consequently, the void ratio therein does not decrease and the specific thermal conductivity thereof does not become large. Therefore, deterioration of the adiathermancy of the heat insulating layer can be avoided. For example, when the fixing roller 11 and the pressure roller (heat insulating roller) 12 having the structure mentioned above were pressed against each other with a plane pressure of 3 kg/cm$^2$, the heat insulating layer 17 (17A to 17D) transformed little and a uniform nip was formed. In addition, the heat insulating layer 17 can be sealed by the metal core 16 and the surface layer (release layer) 19 and be subject to pressure reduction treatment. Thereby, the effect of heat insulation increases. The compression and transformation causing deterioration in adiathermancy or fluctuation in conveying speed at the fixing nip is ignorable when the roller surface has a hardness not less than 60 degree by ASKER C and preferably not less than 80 degree to cover a higher plane pressure area.

Next, a second example of a fixing device of the present invention is described with reference to FIG. 15.

Figure 15:
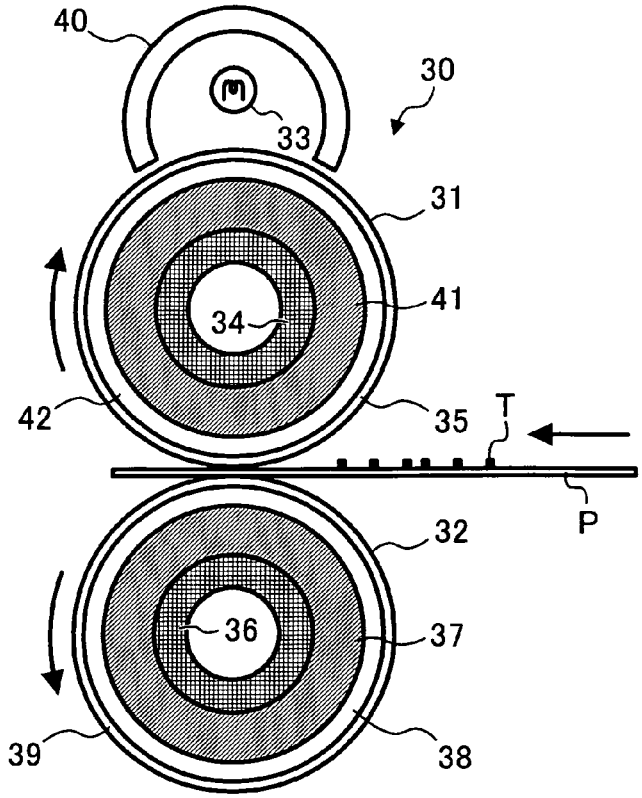
FIG. 15 is a cross section illustrating a second embodiment of a fixing device of the present invention.

A fixing device 30 illustrated in FIG. 15 is a fixing device including a heating system including a halogen heater 33 as a heat source disposed outside a fixing roller 31. A reflection board 40 is provided to reflect the radiation heat from the halogen heater 33 to the direction of the fixing roller 31. The structure of a pressure roller (heat insulating roller) 32 is the same as that of the pressure roller 12 illustrated in FIG. 12 and includes a metal core 36 on which a heat insulating layer 37, an elastic layer 38, and a release layer 39 are formed in this order. In addition, the structure of the fixing roller 31 is the same as that of the pressure roller 32 and includes a metal core 34 on which a heat insulating layer 41, an elastic layer 42, and a release layer 35 are formed in this order. The heat insulating layer 41 of the fixing roller 31 and the heat insulating layer 37 of the pressure roller 32 can adopt the same structure as any structure of the heat insulating layers 17A to 17D illustrated in FIGS. 3 to 6. In this embodiment, the layer thickness of the heat insulating layers 41 and 37 may be 2 mm. The elastic layers 42 and 38 may be a silicone rubber layer having a thickness of 0.3 mm. A PFA tube having a thickness of, e.g., 15 μm is coated on the elastic layers 42 and 38 as release layers (surface layers) 35 and 39, respectively.

In the fixing device 30 of this example, the radiation heat from the halogen heater 33 is supplied to the surface of the fixing roller 31 and is not conveyed much to the internal portion (the metal core 34) thereof. Thus, the fixing device can effectively apply heat to the toner and the recording medium. Similar to the pressure roller 32 (and the pressure roller 12 illustrated in FIG. 2), the fixing roller 31 has a good rigidity and therefore a uniform fixing nip can be formed.

Next, a third example of a fixing device of the present invention is described with reference to FIG. 16.

Figure 16:
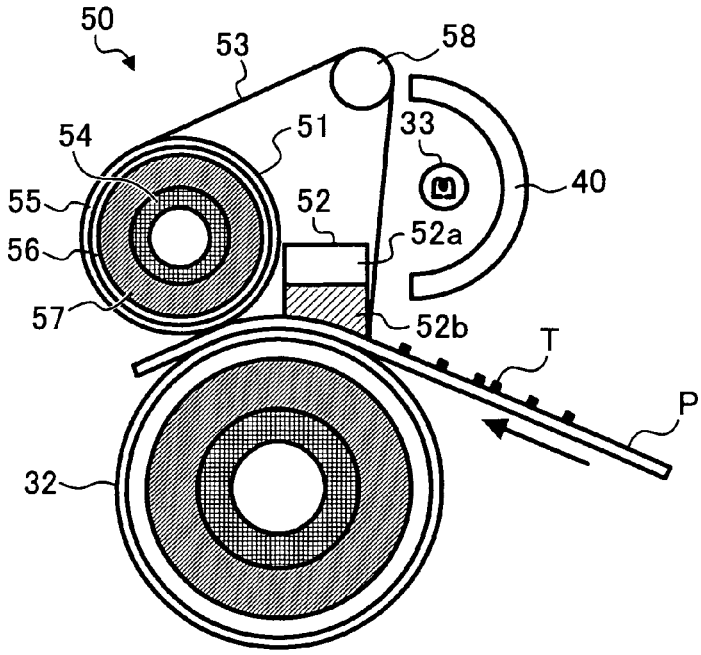
FIG. 16 is a cross section illustrating a third embodiment of a fixing device of the present invention.

A fixing device 50 illustrated in FIG. 16 is a fixing device including a fixing belt. A pressure roller 32, a halogen heater 33, and a reflection board 40 of the fixing device 50 are the same as those of the fixing device 30 illustrated in FIG. 15 and thus their descriptions are omitted. A fixing belt (a heating belt) 53 is suspended over a fixing roller 51, a second fixing member 52, and a supporting roller 58 situated in the loop of the fixing belt 53. The second fixing member 52 can be referred to as a nip forming member representing a member contacting a pressure roller while depressing the pressure roller. The halogen heater 33 is disposed opposite to a side of the fixing belt 53 (i.e., the side formed between the second fixing member 52 and the supporting roller 58) to heat the fixing belt 53. In FIG. 16, the fixing belt 53 is rotated clockwise by the fixing roller 51 functioning as a driving roller that is driven by a driving device (not shown).

The fixing nip of the fixing device 50 of this embodiment is formed when the pressure roller 32 is in contact under pressure with the second fixing member 52 and the fixing roller 51 with the fixing belt 53 therebetween. The second fixing member 52 located on the upstream side in the fixing nip forms the first nip and the fixing roller 51 located on the downstream side in the fixing nip forms the second nip. The fixing nip is formed in a manner in which the fixing belt 53 is rolled around the pressure roller 32 by the second fixing member 52 and the fixing roller 51. A recording medium P is conveyed into the fixing nip from right to left in this figure and receives the heat of the fixing belt 53 such that the toner T is fixed onto the recording medium P. The fixing belt 53 of this embodiment is formed of a substrate including a polyimide on which a silicone rubber layer having a thickness of, e.g., 0.2 mm as an elastic layer and a PFA coating layer having a thickness of, e.g., 10 μm as a release layer are formed.

The fixing roller 51 is the same as the fixing roller 31 illustrated in FIG. 15 except that its roller diameter is smaller than that of the pressure roller 32. The fixing roller 51 is a heat insulating roller including a metal core 54 on which a heat insulating layer 57, an elastic layer 56, and a release layer 55 are formed. Therefore, the heat of the fixing belt 53 is not easily transferred to the internal portion of the fixing roller 51 and the heat of the fixing belt 53 does not diffuse unnecessarily, resulting in prevention of a fall in the temperature thereof. In addition, the second fixing member 52 includes a supporting member 52*a* and a heat insulating member 52*b* attached thereto. Thus, the heat of the fixing belt 53 is not easily transferred to the supporting member 52*a*, and consequently the heat of the fixing belt 53 does not diffuse unnecessarily, resulting in prevention of a fall in the temperature thereof. Since the supporting member 52*a* is needed to be rigid, it is preferred to use metals such as iron, SUS, and aluminum therefor.

Figure 17A:
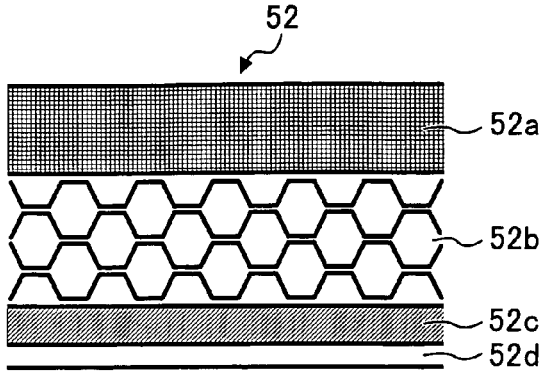
FIGS. 17A and 17B are cross sections illustrating an embodiment of a member for fixing of a fixing device with an abrasively-contacting layer and an elastic layer and with a lubricant applied on a surface of a heat insulating layer, respectively.
Figure 17B:
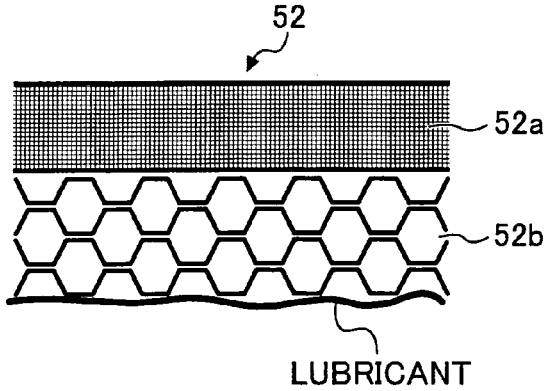

FIG. 17 is a cross section illustrating a structural embodiment of the second fixing member 52. Since the second fixing member 52 is abrasively in contact with the fixing belt 53, the second fixing member 52 needs to have a low friction factor. The structure illustrated in FIG. 17A includes a supporting member 52*a* on which the heat insulating layer 52*b*, an elastic layer 52*c*, and an abrasion-contacting layer 52*d* are formed. The abrasion-contact layer 52*d* as a surface layer includes a fluorine resin having a low friction factor. The structure illustrated in FIG. 17B uses a lubricant such as oil and grease to reduce its friction factor. In this embodiment, no abrasion-contact layer and no elastic layer are necessary, and thus a lubricant is directly applied on the surface of the heat insulating layer 52*b* as illustrated. The heat insulating layer 52*b* is formed by a film having concavities and convexities on its surface. The surface having the concavity and convexity holds the lubricant so that the lubricant does not easily run out.

The heat insulating layer 57 of the fixing roller 51 and the heat insulating member 52*b* of the second fixing member 52 can adopt the same structure as any one of the heat insulating layers 17A to 17D described with reference to FIGS. 3 to 6. Further, the pressure roller 32 includes the heat insulating layer 37 as illustrated in FIG. 15 and thus does not easily convey the heat of the fixing belt 53 to the internal portion of the pressure roller 32. Therefore, the heat of the fixing belt 53 does not diffuse unnecessarily, resulting in prevention of a fall in the temperature thereof.

In the fixing device 50 of this embodiment, a heat source (i.e., the halogen heater 33) is disposed on the upstream side of the fixing nip and applies heat to the fixing belt 53 from a surface thereof (i.e., the surface that contacts unfixed toner). In addition, each of the first and the second fixing members (i.e., the fixing roller 51 and the second fixing member 52) and the pressure roller 32 serving to form the fixing nip has a heat insulating layer. Therefore, the heat held in the fixing belt 53 is not easily transferred to the substrates (i.e., the roller metal cores 54 and 36 and the supporting member 52*a*) of the members forming the fixing nip. Thus, the heating belt 53 can effectively apply heat to toner and recording media.

In addition, the heat insulating layers in the members of forming the fixing nip have a good rigidity so that the formed fixing nip is uniform.

In this example, each of the second fixing member 52 serving as a member for fixing, the fixing roller 51 serving as a roller for fixing, and the pressure roller 32 includes a heat insulating layer. The adiathermancy of the member for fixing, the roller for fixing, and the pressure roller is improved by adopting for the heat insulting layer thereof the same structure as any one of the heat insulating layers 17A to 17D described with reference to FIGS. 3 to 6.

Next, two examples of a fourth embodiment of a fixing device of the present invention are described with reference to FIGS. 18 and 19.

Figure 18:
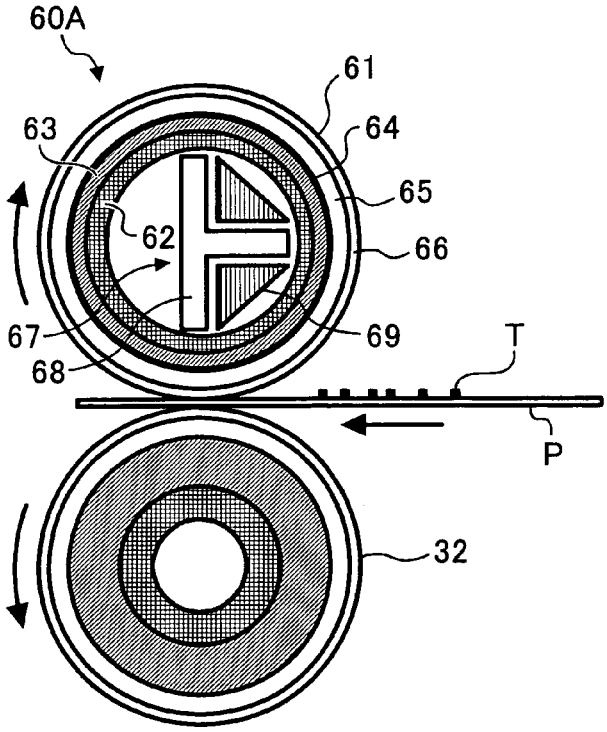
FIG. 18 is a cross section illustrating a fourth embodiment of a fixing device of the present invention.

A fixing device 60A illustrated in FIG. 18 is a fixing device taking a heat induction system. The pressure roller in these examples is the same as the pressure roller 32 of the fixing device 30 illustrated in FIG. 15. Thus, the same numeral is assigned thereto and its description is omitted.

The fixing roller 61 includes a roller substrate 62 on which a heat insulating layer 63, an electric conductive layer (i.e., a heat generating layer) 64, an elastic layer 65, and a release layer 66 are formed. The roller substrate 62 is made of a resin since this roller adopts a heat induction system. The roller substrate is not limited to a resin roller and another roller such as a glass roller is also suitable in light of heat resistance and rigidity. The heat insulating layer 63 can adopt the same structure as any one of the heat insulating layers 17A to 17D described with reference to FIGS. 3 to 6. The electric conductive layer 64 may be a nickel sleeve having a thickness of 40 μm. The elastic layer 65 may be a silicone rubber layer having a thickness of 0.5 mm. As the surface layer, the release layer 66 as the surface layer including a PFA tube having a thickness of, e.g., 15 μm is coated on the elastic layer 65. Inside the fixing roller 61, a heat induction device 67 is provided. The heat induction device includes a bobbin 68 on which an induction coil 69 is wound.

In the fixing devices 60A and 60B of these examples, the rise time can be shortened by using this heat induction system. In addition, the heat induction device 67 is disposed inside the heat insulating layer 63. Thereby, the heat of the electric conductive layer (i.e., heat generating layer) 64 is effectively blocked so that the heating efficiency does not become low. Namely, efficiency of the induction coil 69 tends to become low as its temperature rises, but the heat of the electric conductive layer 64 is not easily transferred to the induction coil 69 due to the existence of the heat insulating layer 63. Thus, deterioration of the efficiency of the induction coil 69 can be restrained. The electric conductive layer (i.e., heat generating layer) 64 is not limited to a nickel sleeve and can be formed by an electric conductive polymer, plated metal, material containing carbon, and their combination formed on the outermost film layer in the heat insulating layer 63. The rise time properties are good by using these electric conductive layers.

Figure 19:
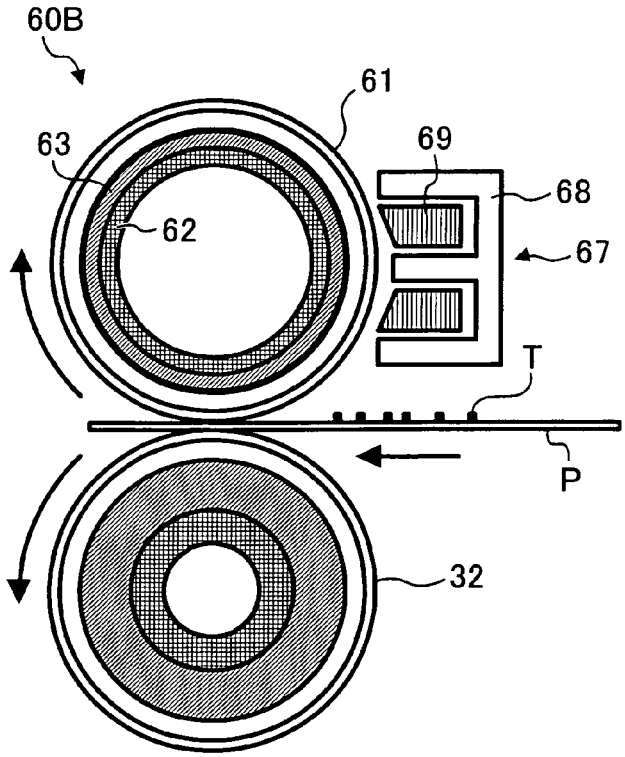
FIG. 19 is a cross section illustrating an embodiment in which a heat induction device is disposed outside a fixing roller.

A fixing device 60B illustrated in FIG. 19 is the same as the fixing device 60A illustrated in FIG. 18 except that the heat induction device 67 is disposed outside the fixing roller 61. In this fixing device 60B, the heat insulating layer 63 of the fixing roller 61 does not have the effect of not easily conveying heat to the induction coil 69. However, since the heat insulating layer 63 can block the transfer of the heat to the roller substrate 62 located inside the electric conductive layer (heat generation layer) 64, deterioration of efficiency of heat application can be prevented. In addition, since the heat induction device 67 is disposed outside the fixing roller 61, the maintenance properties such as changing/assembling rollers are improved.

In this example, a heat insulating layer is provided to each of the fixing roller 61 and the pressure roller 32 functioning as rollers for fixing and the heat insulating layer adopts the same structure as any one of the heat insulating layers 17A to 17D described with reference to FIGS. 3 to 6 to improve adiathermancy of the rollers for fixing.

Next, an example of a fifth embodiment of a fixing device of the present invention is described with reference to FIG. 20.

Figure 20:
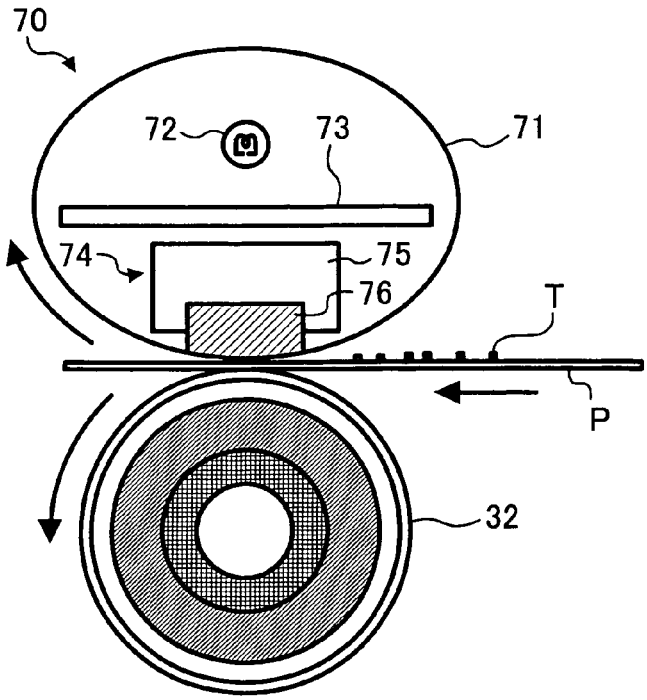
FIG. 20 is a cross section illustrating a fifth embodiment of a fixing device of the present invention.

A fixing device 70 illustrated in FIG. 20 is a fixing device using a fixing belt 71 and a halogen heater 72 functioning as a heat source is disposed inside the fixing belt 71. A fixing member 74 (a member for fixing) forming a nip is located in the loop of the fixing belt 71 opposite to the pressure roller 32, and this fixing member 74 is in contact under pressure with the pressure roller 32 with the fixing belt 71 therebetween. The fixing member 74 includes a supporting member 75 and a heat insulating material 76 attached thereto. A reflection board 73 is provided between the halogen heater 72 and the fixing member 74 to efficiently convey the heat of the halogen heater 72 to the fixing belt 71. The pressure roller 32 is identical to that in the fixing device 30 illustrated in FIG. 15 and thus its description is omitted.

Since the fixing member 74 is abrasively in contact with the fixing belt 71, the fixing member 74 can adopt the same structure as that of the second fixing member 52 in the fixing device 50 illustrated in FIG. 16. Namely, the structure includes the heat insulating material 76 (the heat insulating layer 52*b*) and the elastic layer 52*c* and the abrasion-contact layer 52*d* that are formed thereon as illustrated in FIG. 17A or the structure including the heat insulating material 76 (the heat insulating layer 52*b*) having a surface on which a lubricant such as oil and grease is applied without providing such an abrasive-contact layer and an elastic layer as illustrated in FIG. 17B.

In the fixing device 70, the fixing member 74 fixedly disposed inside the fixing belt 71 is in contact under pressure with the pressing member 32 to form a nip. To form a uniform nip without a bending, a supporting member 75 forming the fixing member 74 is preferred to be a rigid metal or a substance having an equivalent rigidity thereto. When the supporting member 75 is made of a metal frame or the like, its heat capacity is large. Thus, when the supporting member 75, which is not involved in fixing is heated, the heating efficiency deteriorates. To prevent this deterioration, a reflection board 73 is provided between the fixing member 74 and the halogen heater 72. Also, the fixing member 74 receives the heat from the fixing nip. However, in this example, the heat from the fixing belt 71 is not easily transferred to the supporting member 75 because the heat insulating material 76 is used for directly forming the nip. Thereby, the heat from the fixing belt 71 is not easily transferred to the supporting member 75 and deterioration of heating efficiency can be prevented. The heat insulating member 76 of the fixing member 74 can adopt the same structure as any structure of the heat insulating layers 17A to 17D described with the reference to FIGS. 3 to 6.

In this embodiment, a heat insulating layer is provided to each of the fixing member 74 functioning as a member for fixing and the pressure roller 32 functioning as a roller for fixing and the heat insulating layers adopt the same structure as any structure of the heat insulating layer 17A to 17D described with reference to FIGS. 3 to 6 to improve adiathermancy of the members for fixing and the roller for fixing.

Next, a sixth embodiment of a fixing device of the present invention is described with reference to FIG. 21.

Figure 21:
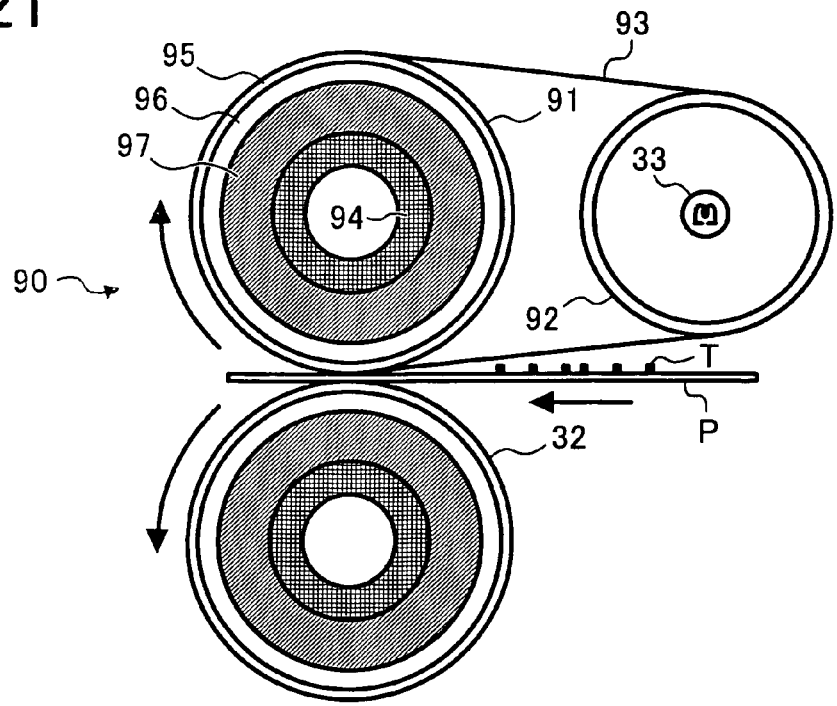
FIG. 21 is a cross section illustrating a sixth embodiment of a fixing device of the present invention.

A fixing device 90 illustrated in FIG. 21 is a fixing device including a fixing belt 93 that is heated from its inside by a heating roller 92. The heating roller 92 is made of aluminum and includes the halogen heater 33 built therein. A fixing belt 93 is stretched over a fixing roller 91 and the heating roller 92. The pressure roller 32 is in contact under pressure with the fixing roller 91 with the fixing belt 93 therebetween to form a fixing nip.

The fixing roller 91 is a heat insulating roller and includes a metal core 94 and a heat insulating layer 97, an elastic layer 96, and a release layer 95 that are formed on the metal core 94. Thus, the heat from the fixing belt 93 is not easily transferred to the internal portion of the fixing roller 91. Thereby, unnecessary diffusion of the heat of the fixing belt 93 can be prevented, resulting in restraint of a fall in the temperature thereof. The heat insulating layer 97 can adopt the same structure as any structure of the heat insulating layer 17A to 17D described with reference to FIGS. 3 to 6. The pressure roller 32 and the halogen heater 33 are identical to those in the fixing device 30 illustrated in FIG. 15 and thus their descriptions are omitted.

In the fixing device 90 of this embodiment, the heat of the fixing belt 93 heated by the heating roller 92 is not easily transferred to the metal core of the fixing roller 91 because the fixing roller 91 has the heat insulating layer 97 Therefore, the fixing device 90 of this embodiment has good heating efficiency and can shorten the rise time. In addition, the number of members for use in the fixing device 90 is fewer than that of the fixing device 50 illustrated in FIG. 16, and thus the cost of the fixing device 90 is lowered. Further, there is no member that is abrasively in contact with the fixing belt 93, resulting in improvement in durability.

For a fixing device, there is also a toner offset problem other than the issues for the rise time and the temperature fall at the time of continuous paper feeding. Toner offset is a phenomenon in which toner on a recording medium is not fixed thereon and a portion of the unfixed toner is transferred to the fixing roller. This unfixed toner may remain on the fixing roller or is transferred back to a recording medium, resulting in deterioration of image quality. As countermeasures to this toner offset problem, there is provided a fixing device including a cleaning roller contacting a fixing roller and/or a pressure roller. A typical cleaning roller is poorer in releasability of its surface relative to that of the surface of a fixing roller and a pressure roller. Such a cleaning roller can scrape toner remaining on the surface of a fixing roller and a pressure roller by utilizing this difference in releasability. However, when such a cleaning roller is in contact with a fixing roller or a pressure roller, the cleaning roller deprives the fixing roller or the pressure roller of heat and thus the rise time becomes longer.

Therefore, the present inventors recognized the heat absorbed by a cleaning roller can be minimized by providing the same heat insulating layer as any layer of the heat insulating layers 17A to 17D described with reference to FIGS. 3 to 6 inside the surface layer of the cleaning roller. Thereby, it is possible to prevent the rise time of the fixing device from being long while the cleaning roller is provided to remove offset toner.

Figure 22:
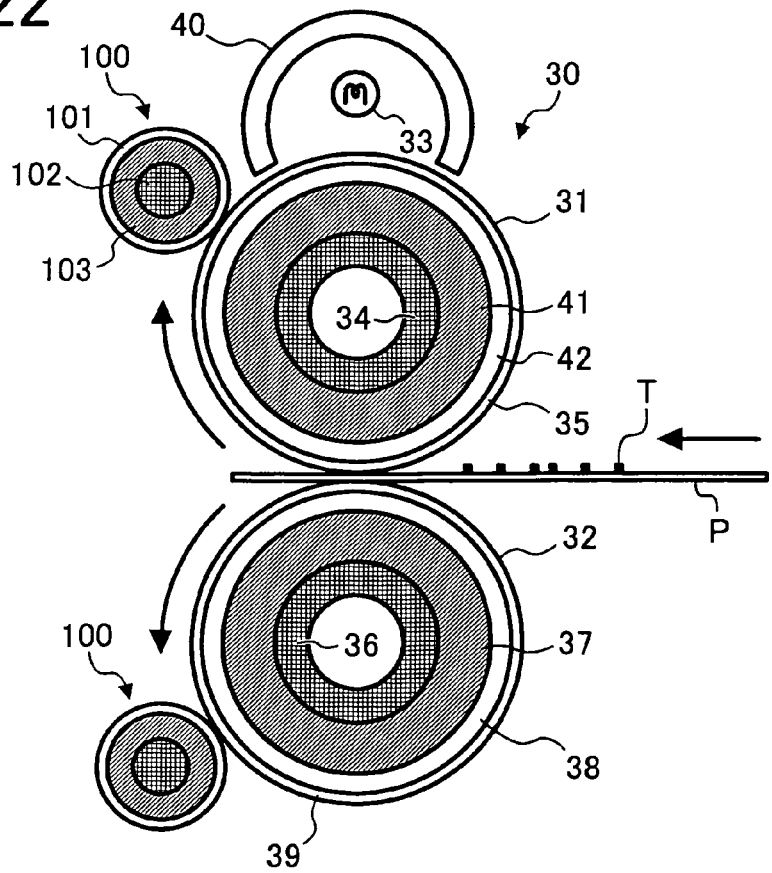
FIG. 22 is a cross section illustrating an embodiment in which cleaning members are provided in contact with rollers for fixing of the fixing device illustrated in FIG. 15.

In FIG. 22, a cleaning roller 100 is provided to be in contact with each of the fixing roller 31 and the pressure roller 32 of the fixing device 30 described with reference to FIG. 15. The cleaning roller 100 illustrated in FIG. 22 includes a heat insulating layer 103 between a surface layer 101 and a metal core 102. The heat insulating layer 103 can adopt the same structure as any structure of the heat insulating layers 17A to 17D described with reference to FIGS. 3 to 6. Thereby, the amount of heat absorbed from the fixing roller 31 and the pressure roller 32 by the cleaning roller 100 can be decreased, and thus the rise time of the fixing device is prevented from being lengthened while the cleaning roller 100 removes the toner offset to the fixing roller 31 and the pressure roller 32.

Any material can be used for the surface layer of a cleaning roller as long as its releasability is poorer relative to that of the surface layer of a fixing roller or a pressure roller. Specific examples of such materials include metals such as aluminum and non-woven fabric.

The cleaning roller 100 illustrated here can also be provided to the fixing rollers or the pressure rollers in the fixing devices of each embodiment other than the fixing device 30 described with reference to FIG. 15 and the same effect mentioned above can be obtained in each case.

When each fixing device mentioned above was set in the image forming apparatus illustrated in FIG. 1 (i.e., as the fixing device 10 illustrated in FIG. 1) and images were formed and fixed with the image forming apparatus, there was no delay in the rise time for a first operation in the morning and no poor fixing expected to be caused by temperature falls at the time of continuous paper feeding. In addition, the rise time to be taken before the temperature of the fixing device reaches the lowest temperature at which fixing was possible was extremely short.

Figure 23:
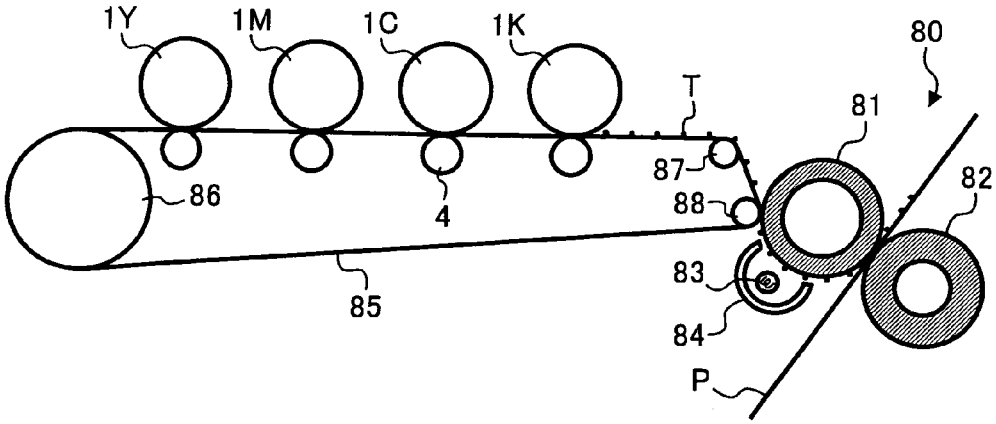
FIG. 23 is a schematic diagram illustrating an embodiment of an image forming portion and its vicinity of an image forming apparatus.

Next, another embodiment of an image forming apparatus of the present invention is described with reference to FIG. 23. FIG. 23 is a schematic diagram illustrating an image developing portion of the image forming apparatus and its vicinity.

The image forming apparatus illustrated in this FIG. 23 is an image forming apparatus taking a four tandem system including four image developing units for four colors disposed in parallel. Each image developing unit has the same structure and includes a photoreceptor drum 1 (1Y, 1M, 1C, 1K) around which devices such as a charging device, a developing device, a transfer device, a cleaning device, and a discharging device necessary for electrophotographic processes are disposed. Each color image developing unit is located in parallel along a side of an intermediate transfer belt 85. The intermediate transfer belt 85 is stretched over a driving roller 86, a supporting roller 87, and an opposing roller 88. A transfer roller 4 serving as a first transfer device is provided inside the loop of the intermediate transfer belt 85 at the place opposite to each photoreceptor drum 1.

A fixing device 80 attached to the image forming apparatus of the present invention has the same structure as that of the fixing device 30 described with reference to FIG. 15 and basically includes a fixing roller 81, a pressure roller 82, a halogen heater 83, and a reflection board 84. The fixing roller 81 and the pressure roller 82 have the same structure as those of the fixing roller 31 and the pressure roller 32 described with reference to FIG. 15, respectively and include the heat insulating layer 17 described with reference to FIGS. 3 to 6. The fixing roller 81 is disposed to be in contact under pressure with the intermediate transfer belt 85 at the position of the opposing roller 88.

In the image forming apparatus having the structure mentioned above, an unfixed toner image overlapped on the intermediate transfer belt 85 from each photoreceptor 1, or an unfixed toner image on the intermediate transfer belt 85 from the photoreceptor 1K in the case of a monochrome print, is transferred onto the fixing roller 81 by the function of the opposing roller 88. The unfixed toner borne on the fixing roller 81 is conveyed by the rotation thereof to the fixing nip where the fixing roller 81 and the pressure roller 82 are in contact under pressure with each other and fixed onto a recording medium P upon application of heat and pressure.

The fixing roller 81 includes a metal core on which a heat insulating layer including a plurality of film layers having a thickness of, e.g., 0.5 mm are accumulated. On the heat insulating layer, a PFA tube having a thickness of, e.g., 15 μm is coated as a release layer.

In the fixing device 80 of this embodiment, unfixed toner transferred onto the fixing roller 81 is directly heated by a halogen heater 83, meaning that it is unnecessary to heat the members for fixing (i.e., the fixing roller 81 in this case) and the fixing device can be ready in action for operation instantly. The heat of the toner heated does not diffuse much to the metal core of the fixing roller by the effect of the heat insulating layer, meaning that the heat is conveyed efficiently.

In this embodiment, a heat insulating layer is provided to each of the fixing roller 81 and the pressure roller 82 functioning as a roller for fixing and the heat insulating layer adopts the same structure as any structure of the heat insulating layer 17A to 17D described with reference to FIGS. 3 to 6 to improve adiathermancy of the rollers for fixing.

Figure 24:
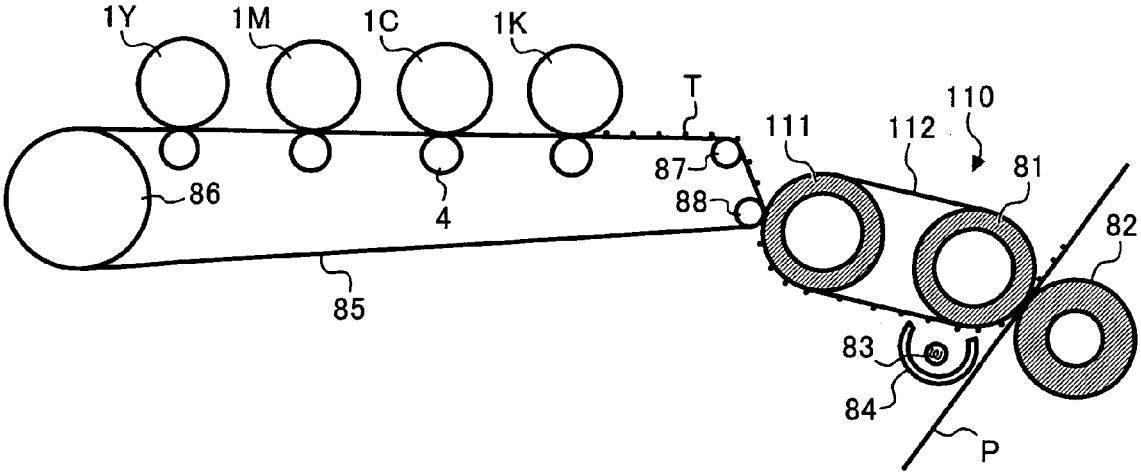
FIG. 24 is a schematic diagram illustrating an embodiment of an image forming portion and its vicinity of an image forming apparatus comprising a fixing device using a fixing belt.

FIG. 24 is a diagram illustrating yet another embodiment of an image forming apparatus including a fixing device using a fixing belt. The same numerals are assigned to the portions corresponding to the portions of the image forming apparatus illustrated in FIG. 23 and their descriptions are omitted.

In FIG. 24, a fixing device 110 includes a fixing belt 112 stretched over the fixing roller 81 and a secondary transfer roller 111 and applies heat to the fixing belt 102 by a halogen heater 83 disposed before the nip formed by the fixing roller 81 and the pressure roller 82. The secondary transfer portion includes a secondary transfer roller 111 located outside the intermediate transfer belt 85 and an opposing roller 88 located inside the intermediate transfer belt 85 while the opposing roller 88 is in contact under pressure with the secondary transfer roller 111 with the intermediate transfer belt 85 therebetween.

In this embodiment, a heat insulating layer is also provided to each of the fixing roller 81 and the pressure roller 82 to restrain the amount of heat reaching the metal core of both rollers, and thus the fixing belt 112 can be heated efficiently. The heat insulating layer can adopt the same structure as any structure of the heat insulating layers 17A to 17D described with reference to FIGS. 3 to 6. Further, in this embodiment, since the fixing roller 81 is not disposed in the secondary transfer portion (i.e., different from the case illustrated in FIG. 23, the fixing roller 81 is not in contact under pressure with the opposing roller 88 and the intermediate transfer belt 85), the amount of heat transferred from the fixing portion to the image developing portion can be reduced, resulting in improvement of heating efficiency.

Having now fully described the present invention with reference to the figures, it will be apparent to one of ordinary skill in the art that many changes and modifications can be made thereto without departing from the spirit and scope of the present invention as set forth therein. For example, in a fixing device having a suitable structure, the effect of the present invention can be obtained by providing the heat insulating layer described with reference to FIGS. 3 to 6 to members involved in forming a fixing nip such as a fixing roller, a pressure roller, and a depressing member. As an image forming apparatus, it is obvious that, other than printers, photocopiers, facsimile machines, multifunctional machines, etc. are also included.

This document claims priority and contains subject matter related to Japanese Patent Applications Nos. 2003-378196 and 2004-269840, filed on Nov. 7, 2003 and Sep. 16, 2004, respectively, the entire contents of each of which are hereby incorporated herein by reference.

What is claimed as new and desired to be secured by Letters Patent of the United States is:

1. A fixing device comprising:

at least one fixing member configured to fix a toner image on a transfer material, and comprising a first substrate, and not including a heat insulating layer;

a pressing member configured to form a nip with the at least one fixing member, and comprising a second substrate; and a heater, wherein the pressing member further comprises a heat insulating layer overlying the second substrate.

2. A fixing device comprising:

at least one fixing member configured to fix a toner image on a transfer material, and comprising a first substrate;

a pressing member configured to form a nip with the at least one fixing member, and comprising a second substrate; and a heater, wherein at least one of the at least one fixing member and the pressing member further comprises a heat insulating layer overlying the first or second substrate, wherein the heat insulating layer comprises:

accumulated film layers; and a filler dispersed between the accumulated film layers to form spaces therebetween.

3. The fixing device according to claim 2, wherein the filler comprises a particulate material.

4. The fixing device according to claim 3, wherein the filler comprises a particulate hollow material.

5. The fixing device according to claim 2, wherein the filler comprises a fiber.

6. The fixing device according to claim 5, wherein the filler comprises a hollow fiber.

7. The fixing device according to claim 2, wherein the accumulated film layers are adhered to each other or the accumulated film layers and the filler are adhered to each other.

8. The fixing device according to claim 2, wherein at least one of the at least one fixing member and the pressing member comprises a roller substrate and the accumulated film layers comprise a film sheet spirally wound around the roller substrate such that a winding direction of the film sheet is opposed to a rotation direction of the roller substrate.

9. The fixing device according to claim 1, wherein the heat insulating layer comprises accumulated film layers each having a concavo-convex surface to form spaces therebetween.

10. The fixing device according to claim 9, wherein the heat insulating layer further comprises a flat film alternately disposed with the film layer having concavo-convex surface.

11. The fixing device according to claim 1, wherein the at least one fixing member is a heat induction roller comprising a heat generating layer.

12. The fixing device according to claim 1, further comprising a fixing belt, wherein the fixing belt is rotated while being sandwiched by the at least one fixing member and the pressing member.

13. The fixing device according to claim 1, further comprising:

a heat roller heated by the heater; and a fixing belt configured to receive heat of the heat roller, wherein the fixing belt is rotated while being supported by the at least one fixing member and the heat roller and is sandwiched by the at least one fixing member and the pressing member.

14. The fixing device according to claim 1, wherein the heater is located inside the at least one fixing member.

15. The fixing device according to claim 1, wherein the heater is disposed in a vicinity of the at least one fixing member to apply heat thereto.

16. The fixing device according to claim 15, wherein the heater further directly applies heat to the toner image on the transfer material.

17. The fixing device according to claim 1, further comprising:

at least one cleaning member comprising:

a substrate; and a second heat insulating layer, wherein the at least one cleaning member cleans a surface of at least one of the at least one fixing member and the pressing member.

18. The fixing device according to claim 17, wherein the second heat insulating layer comprises:

accumulated film layers; and a filler dispersed between the accumulated film layers to form spaces therebetween.

19. The fixing device according to claim 17, wherein the second heat insulating layer comprises accumulated film layers each having a concavo-convex surface to form spaces therebetween.

20. A fixing device comprising:

at least one fixing member configured to fix a toner image on a transfer material, and comprising a first substrate;

a pressing member configured to form a nip with the at least one fixing member, and comprising a second substrate; and a heater, wherein at least one of the at least one fixing member and the pressing member further comprises a heat insulating layer overlying the first or second substrate, wherein the heat insulating layer comprises accumulated film layer each having a concavo-convex surface to form spaces therebetween, and wherein the heat insulating layer further comprises a filler dispersed between the accumulated film layers having a concavo-convex surface.

21. A fixing device comprising:

at least one fixing member configured to fix a toner image on a transfer material, and comprising a first substrate;

a pressing member configured to form a nip with the at least one fixing member, and comprising a second substrate; and a heater, wherein at least one of the at least one fixing member and the pressing member further comprises a heat insulating layer overlying the first or second substrate, wherein the heat insulating layer comprises accumulated thermoplastic resin film layers and a particulate hollow material dispersed therebetween while fixed thereto by a thermoplastic resin.

22. An image forming apparatus comprising:

a photoreceptor;

an irradiator configured to irradiate the photoreceptor to form a latent image on the photoreceptor;

a developing device configured to develop the latent image on the photoreceptor with toner to form a toner image on the photoreceptor;

a cleaner configured to remove toner remaining on the photoreceptor;

a discharging device configured to discharge the photoreceptor;

a transferring device configured to transfer the toner image to a recording medium; and a fixing device comprising:

at least one fixing member configured to fix a toner image on a transfer material, and comprising a first substrate, and not including a heat insulating layer;

a pressing member configured to form a nip with the at least one fixing member, and comprising a second substrate; and a heater, wherein the pressing member further comprises a heat insulating layer overlying the second substrate.

23. A heat insulating member comprising:

a support; and a heat insulating layer located overlying the support, comprising:

accumulated film layers; and a filler dispersed between the accumulated film layers to form spaces therebetween.

24. A heat insulating member for use in a fixing device of an image forming device, comprising:

a support; and a heat insulating layer located overlying the support comprising:

accumulated film layers each having a concavo-convex surface to form spaces therebetween.

25. A fixing device comprising:

at least one fixing member configured to fix a toner image on a transfer material, and comprising a first substrate, and not including a heat insulating layer;

a pressing member configured to form a nip with the at least one fixing member, and comprising a second substrate; and a heater, wherein the pressing member further comprises means for heat insulating overlying the second substrate.

26. The fixing device according to claim 25, wherein the at least one fixing member is a heat induction roller comprising a heat generating layer.

27. The fixing device according to claim 25, further comprising a fixing belt, wherein the fixing belt is rotated while being sandwiched by the at least one fixing member and the pressing member.

28. The fixing device according to claim 25, further comprising:

a heat roller heated by the heater; and a fixing belt configured to receive heat of the heat roller, wherein the fixing belt is rotated while being supported by the at least one fixing member and the heat roller and is sandwiched by the at least one fixing member and the pressing member.

29. The fixing device according to claim 25, wherein the heater is located inside the at least one fixing member.

30. The fixing device according to claim 25, wherein the heater is disposed in a vicinity of the at least one fixing member to apply heat thereto.

31. The fixing device according to claim 30, wherein the heater further directly applies heat to the toner image on the transfer material.

32. The fixing device according to claim 25, further comprising:

at least one cleaning member comprising:

a substrate; and second means for heat insulating, wherein the at least one cleaning member cleans a surface of at least one of the at least one fixing member and the pressing member.

33. An image forming apparatus comprising:

a photoreceptor;

an irradiator configured to irradiate the photoreceptor to form a latent image on the photoreceptor;

a developing device configured to develop the latent image on the photoreceptor with toner to form a toner image on the photoreceptor;

a cleaner configured to remove toner remaining on the photoreceptor;

a discharging device configured to discharge the photoreceptor;

a transferring device configured to transfer the toner image to a recording medium; and a fixing device comprising:

at least one fixing member configured to fix a toner image on a transfer material, and comprising a first substrate, and not including a heat insulating layer;

a pressing member configured to form a nip with the at least one fixing member, and comprising a second substrate; and a heater, wherein the pressing member further comprises means for heat insulating overlying the second substrate.

* * * * *